US006145706A

United States Patent [19]

Dinand

[11] Patent Number: 6,145,706

[45] Date of Patent: Nov. 14, 2000

[54] SPRAYING FLASK AND CLOSURE THEREFOR

[75] Inventor: Pierre Dinand, Levallois-Perret, France

[73] Assignee: Industria e Comercio de Cosmeticos Natura Ltda, Brazil

[21] Appl. No.: 09/192,513

[22] Filed: Nov. 17, 1998

Related U.S. Application Data

[63] Continuation of application No. PCT/BR97/00063, Nov. 5, 1997.

[30] Foreign Application Priority Data

Nov. 5, 1996 [BR] Brazil ..... 9605425

[51] Int. Cl.[7] ..... B65D 83/14; B65D 83/22

[52] U.S. Cl. ..... 222/182; 220/724; 220/820; 222/153.13; 222/402.11; 222/402.12; 222/402.13

[58] Field of Search ..... 222/402.11, 402.13, 222/153.13; 137/382

[56] References Cited

U.S. PATENT DOCUMENTS

| | | | |
|---|---|---|---|
| 208,193 | 9/1878 | Michel | 215/277 |
| D. 340,185 | 10/1993 | Martone | 222/402.12 X |
| 1,948,966 | 2/1934 | Jaeger | 220/728 |
| 2,080,728 | 5/1937 | MacNeill et al. | 220/728 |
| 3,352,445 | 11/1967 | Cochin | 220/820 X |
| 3,696,964 | 10/1972 | Deakin | 220/728 |
| 3,770,168 | 11/1973 | Sagarin | 222/182 |
| 4,301,828 | 11/1981 | Martin, Jr. | 220/728 |
| 4,353,483 | 10/1982 | Pehr | 222/182 X |
| 5,139,180 | 8/1992 | Lucas | 222/402.1 X |
| 5,649,645 | 7/1997 | Demarest et al. | 222/153.07 |
| 5,657,905 | 8/1997 | Glynn | 222/182 |
| 5,779,072 | 7/1998 | Krebs | 215/219 |
| 5,788,108 | 8/1998 | Rohr | 215/238 X |

*Primary Examiner*—Allan N. Shoap
*Assistant Examiner*—Joe Merek
*Attorney, Agent, or Firm*—Smith, Gambrell & Russell, LLP

[57] ABSTRACT

A set for restricting the operation of a spray valve of a flask comprising three main parts, namely: a shoulder, a collar and a lid. The shoulder of the set rests on the shoulder of the flask and is connected to a mouth of the flask by projections from the neck of the set. The shoulder of the set is also solidly linked to the collar of the set by an indentation. The collar constitutes a circular section ring that fits inside a mouth of the of the set's shoulder. The lid constitutes a cylindrical piece having a top with a peripheral skirt. The lid is connected to the collar of the set by an extension and a pin. The lid rotates about the pin through a limited arc and has a closed position. When the lid is in the closed position, it encloses a valve of the flask and restricts the operation of the valve.

14 Claims, 8 Drawing Sheets

SPRAYING FLASK AND CLOSURE THEREFOR

REFERENCE TO RELATED APPLICATION

This is a continuation of International Application No. PCT/BR97/00063, filed Nov. 5, 1997, under the Patent Cooperation Treaty.

BACKGROUND OF THE INVENTION

The present invention relates to a set for flask closure, this being a spraying flask. Particularly, the present invention refers to a set comprising three parts, namely, a shoulder, a collar and a lid, designed to enclose a usual spraying valve and meant to be applied to a flask specially adapted to match with this set.

The present invention refers to a set for spraying flasks closure, for example, used to contain fragrances or similar products, and affords a great improvement, because the shoulder of the set rests directly against the upper flask portion and is solidly linked to the collar, which is articulated to the lid enclosing the spraying system valve. This lid has a rotation movement through a limited circle arc, so that when the lid is in its closed position it covers the spraying valve aperture, and, when in the opened position, allows valve operation.

SUMMARY OF THE INVENTION

The shoulder is usually constituted of an injected plastic piece, which usually has the same shape as the upper portion of the flask. The shoulder has an oval section and a neck having a substantially circular section. The shoulder is adapted to rest on the corresponding portions (shoulder, neck and mouth) of the flask onto which it is applied.

The collar is a circular section piece which has one part of its wall inserted into the inner surface of the shoulder's mouth. Besides, the collar has an upright or vertical portion, which contains the pin responsible for the limited lid pivoting. The lid pivoting is limited by a step, in circle arc form in the upper collar rim.

The lid is constituted of a cylindrical piece having a smooth circular covering and a partial lateral surface. Adjacent to one extremity of the partial lateral surface of the lid, there is a vertical portion which articulates with the corresponding upright portion of the collar. The lateral surface of the lid extends approximately through half of the covering circumference, and the lower rims of the partial lateral surface extremities act as a backstop for the lid pivoting. This means that when the lid is in its closed position, these lower rims of the outer edges of the partial lateral surface will strike against the corresponding outer faces of the semi-circular step of the collar.

The lid and collar articulation is obtained through a pin crossing the cylindrical sections of the lid and of the collar, these extensions being solidly connected to the corresponding vertical portions of the lid and of the collar.

A usual spraying valve, having a circular cylindrical body, and having a spraying aperture and a catching tube, is positioned in the inner space of the collar, so that, when the lid is its closed position, the aperture will be covered by the mentioned partial lateral surface of the lid.

The characteristic aspects of the present invention will be evidenced by the following description and enclosed drawings. These refer to the preferential version and illustrate the present invention without establishing any limits.

DETAILED DESCRIPTION

Figure 1:
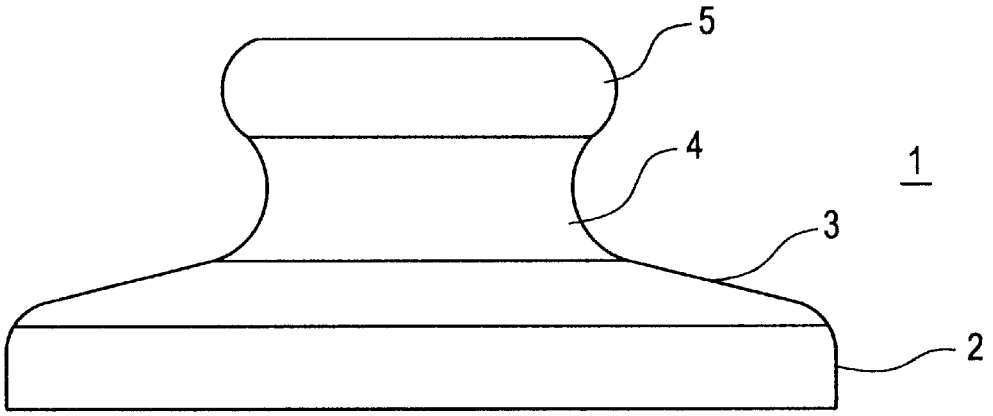
FIG. 1 represents a front top view of the shoulder, which is part of the set for spraying flask closure, according to the present invention.
Figure 3:
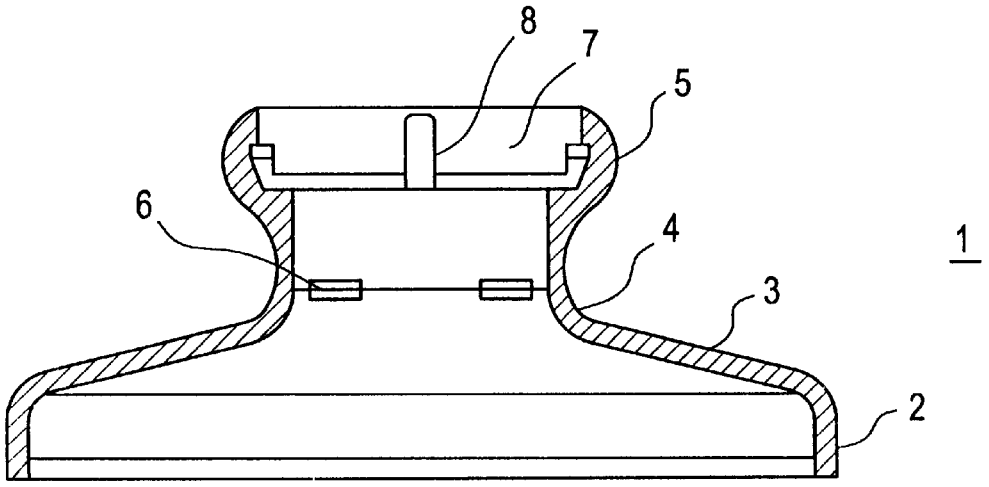
FIG. 3 represents a sectional top view across the plane corresponding to the larger axis of the shoulder illustrated in FIG. 2.
Figure 2:
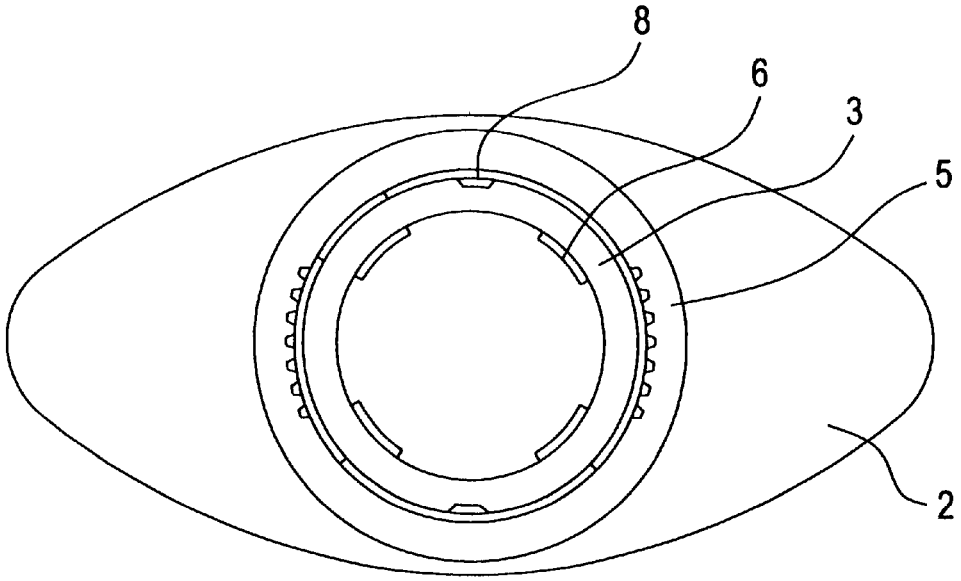
FIG. 2 represents a top plan view of the shoulder illustrated in FIG. 1.
Figure 4:
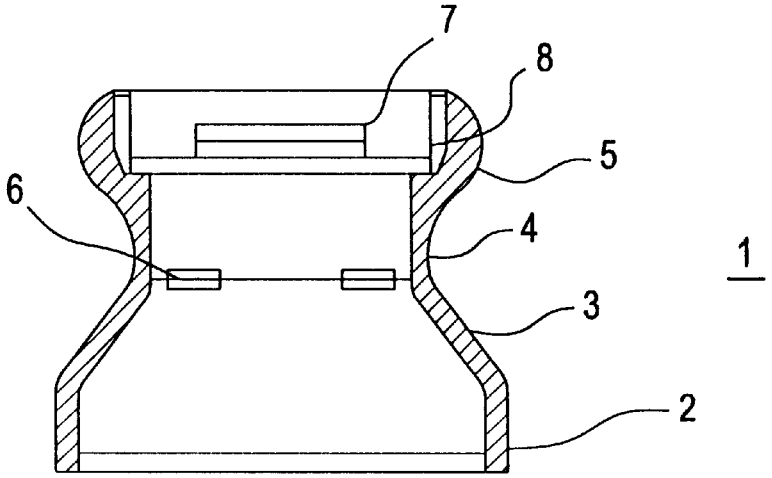
FIG. 4 represents a sectional top view across the plane corresponding to the smaller axis of the shoulder illustrated in FIG. 2.
Figure 5:
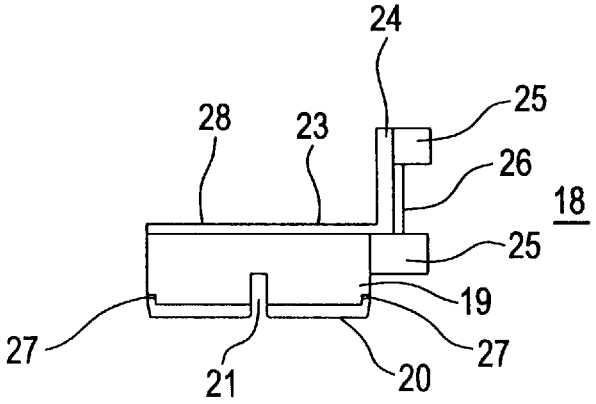
FIG. 5 represents a front top view of the collar, which is part of the set for spraying flask closure, according to the present invention.
Figure 6:
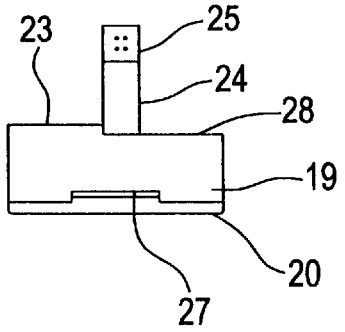
FIG. 6 represents a lateral top view of the collar, in a 90° angle in relation to the top view illustrated in FIG. 6.
Figure 7:
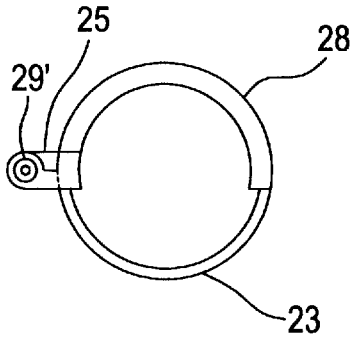
FIG. 7 represents a top plan view of the collar illustrated in FIG. 5.
Figure 8:
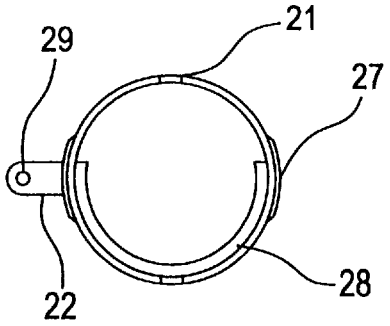
FIG. 8 represents a bottom plan view of the collar illustrated in FIG. 5.
Figure 9:
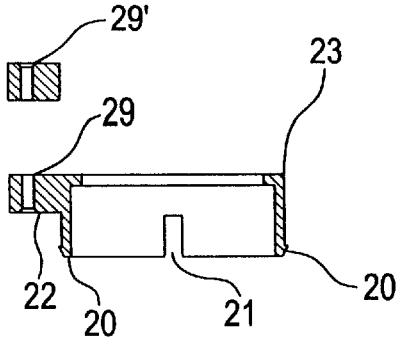
FIG. 9 represents a sectional top view across the plane crossing the horizontal axis of FIG. 7.
Figure 10:
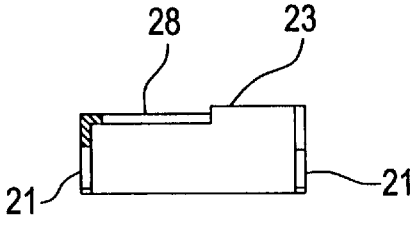
FIG. 10 represents a sectional top view across the plane crossing the vertical axis of FIG. 7.
Figure 11:
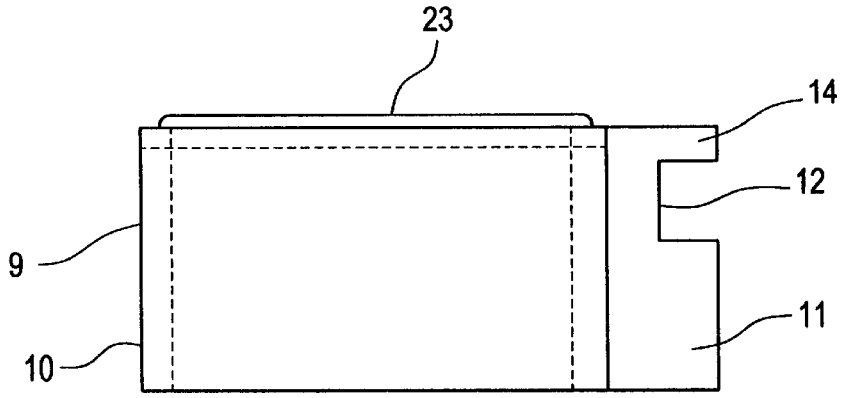
FIG. 11 represents a back top view of the lid, which is part of the set for spraying flask closure, according to the present invention.
Figure 12:
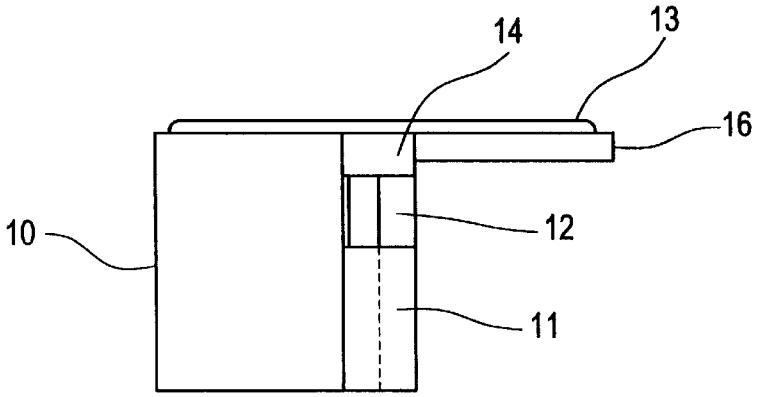
FIG. 12 represents a lateral top view of the articulated extremity of the lid illustrated in FIG. 11.
Figure 13:
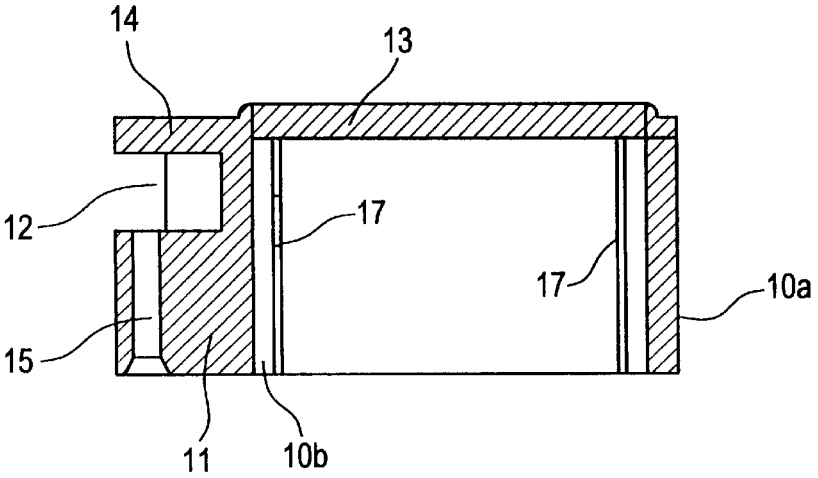
FIG. 13 represents a sectional top view across the plane crossing the vertical axis of the lid illustrated in FIG. 12.
Figure 14:
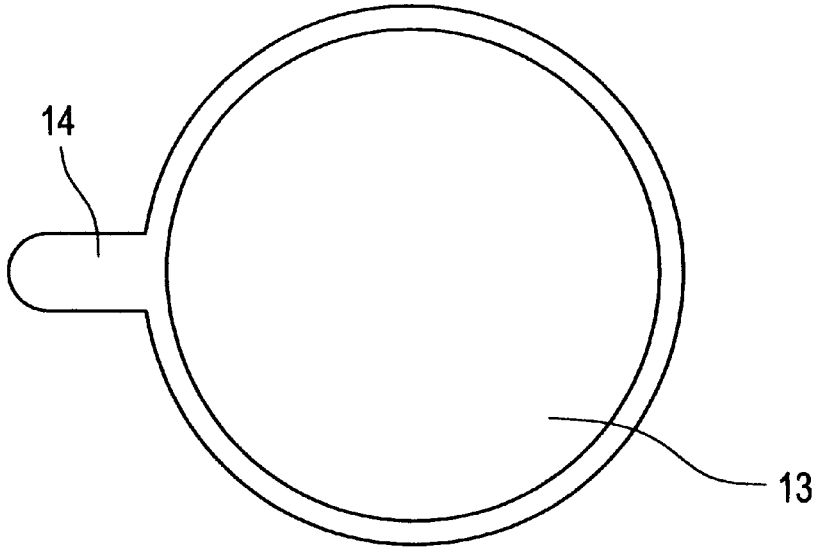
FIG. 14 represents a top plan view of the lid illustrated in FIG. 11.
Figure 15:
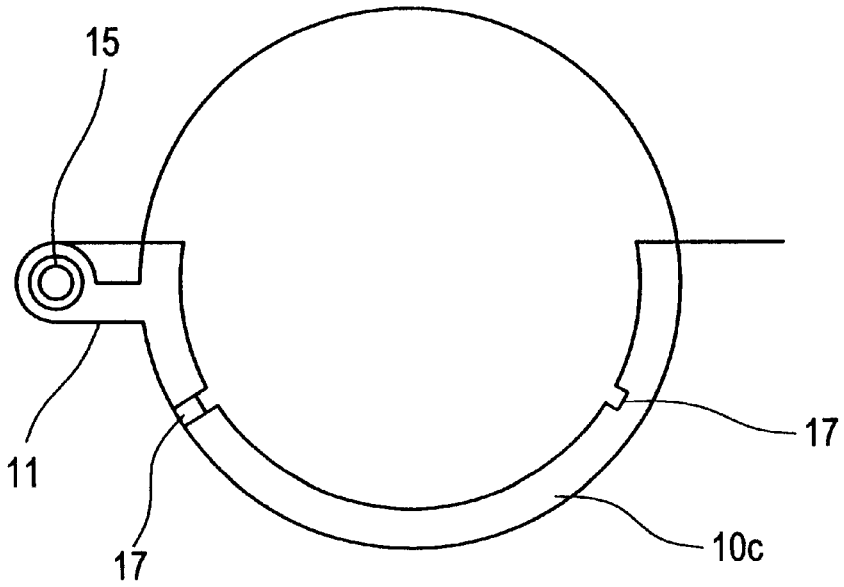
FIG. 15 represents a bottom plan view of the lid illustrated in FIG. 11.

Referring to the drawings, FIGS. 1 to 4 represent the shoulder of the set for spraying flask closure according to the present invention. The shoulder 1, is a plastic piece having an approximately oval section, which is adapted to the upper portion of a flask. The shoulder 1 has a body 3 with a pendant peripheral skirt 2. The body 3 is a convex surface, whose central portion is coincident with the neck 4. This neck 4 has a circular section extended upwards, which enlarges in its upper extremity to form the mouth 5. The diameter of the mouth 5 is relatively greater than the diameter of the neck. The outer surface of the mouth 5 is constituted of a hoop bulged to the outside. The mouth 5 and the neck 4 are coaxial in relation to the shoulder's body 3. In the joint line between the inner surfaces of the shoulder's neck 4 and body 3, can be found projections 6, placed in equispaced manner, to facilitate the fitting of the shoulder in the corresponding flask mouth. In the junction between the inner surfaces of the shoulder's neck 4 and mouth 5, can be found an inner peripheral flange 7. From this flange 7 on, diametrically opposed ribs 8 project vertically upright, and are meant to fit in the corresponding notches (to be described later on) of the collar.

Figure 16:
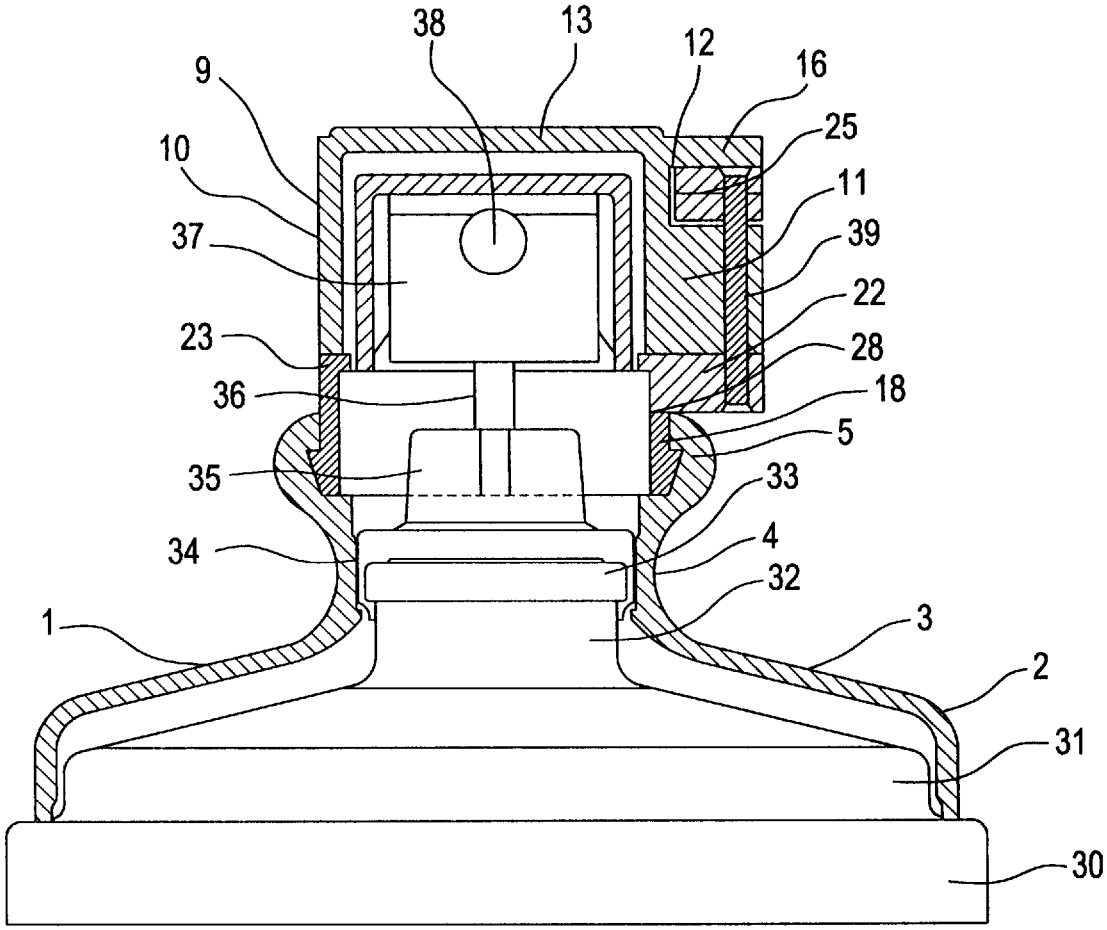
FIG. 16 represents a sectional top view of the front part of the set for spraying flask closure in the assembled position.

FIGS. 5 to 10 are views representing the collar of the set for flask closure, according to the present invention. This collar is generally indicated by the reference number 18. The collar 18 is constituted of a circular section ring, having a lateral surface 19. The lower portion of this lateral surface 19 has a peripheral, interiorly chamfered, section 20 meant to facilitate its fit inside the shoulder's mouth 5, and two diametrically opposed notches 21 meant to fit into the ribs 8 of the inner surface of the shoulder's mouth 5. In the other diametrically opposed positions of the outer surface, adjacent to the chamfered section 20, can be found two indentations 27 meant to facilitate the fixing of the collar 18 inside the shoulder 1. In the assembled position, as illustrated in FIG. 16, the outer surface of the collar 18 is introduced in the inner surface of the shoulder's mouth 5, until above the vertical extension of the notches 21.

The upper rim of the collar 18 is formed by two parts. One such part 23 corresponds to less than a semi-circumference of the rim and is slightly in relief in relation to the other part 28, covers the remaining circumference of the upper rim of the collar. The thickness of part 28 is greater than that of part 23. The fact of part 23 be in relief in relation to part 28, makes the arc extremities of this part 23 act as a backstop to limit the movement of the lid 9 articulated to the collar 18, as will be described later.

An extension 22, having an arched form, with a hole 29 extending through its semicircular portion, projects sideways to the outside as from one of the junctions between the parts 23 and 28 of the collar (the junction at the right side, when the set is in the assembled and closed position). The hole 29 will act as one of the articulation extremities for a pin 39, which is the pivoting element of the lid 9 in relation to the collar 18. From the extension 22, a rectilinear post 24 projects upwards. This post 24 has an indentation 26 in its inner surface, which ends in a cylindrical portion 25. turned outside, with a central hole 29' coaxial in relation to hole 29 of the extension 22.

FIGS. 11 to 15 describe the third part of the set for spraying flask closure, namely the lid 9 which is articulated to the collar 18. The lid 9 is usually constituted of a cylindrical piece having a top 13 with a peripheral skirt 16, a lateral semi-surface 10 having outer and inner vertical edges 10*a* and 10*b*, a lower rim 10*c* and an open base. Adjacent to the inner vertical edge 10*b*, can be found a post 11, in whose upper part can be found an indenture 12 (meant to receive the cylindrical portion 25 of the collar 18). The upper part 14, exhibiting an arched form in plan view, has the same configuration and dimensions as the portion 22 of the collar 18. This part 14 has a blind hole (not illustrated) coaxial in relation to hole 29. This blind hole supports the other end of the articulation pin 39. Coaxial in relation to the hole in part 14 and holes 29 and 29' of the collar, the post 11 has an elongated through hole 15 to house the pin 39. Two vertical notches 17 in the inner lateral surface of the lid 9 help to retain the valve when the lid is in its closed position.

Figure 17:
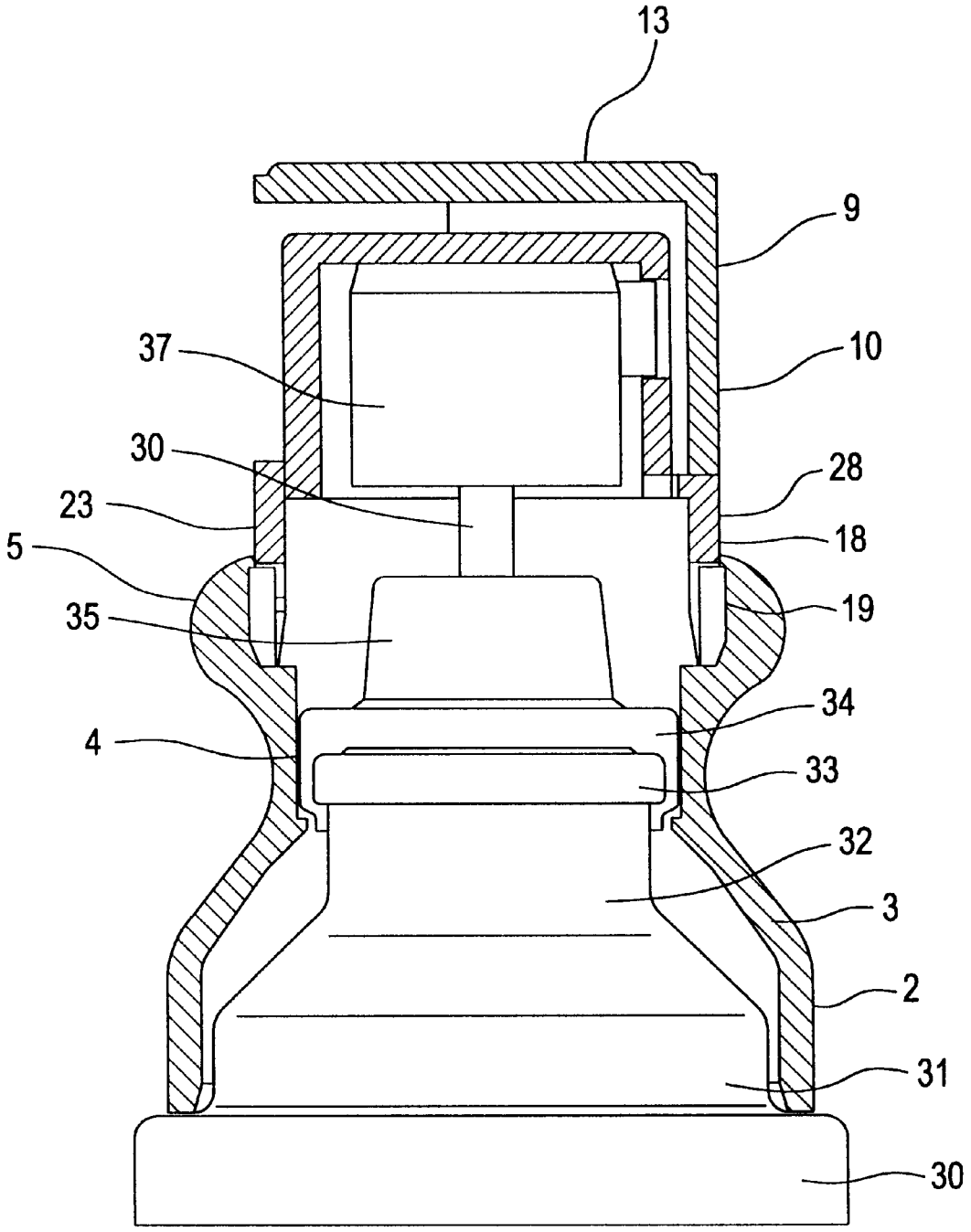
FIG. 17 represents a sectional top view of the lateral part of the set for spraying flask closure in the assembled position.
Figure 18:
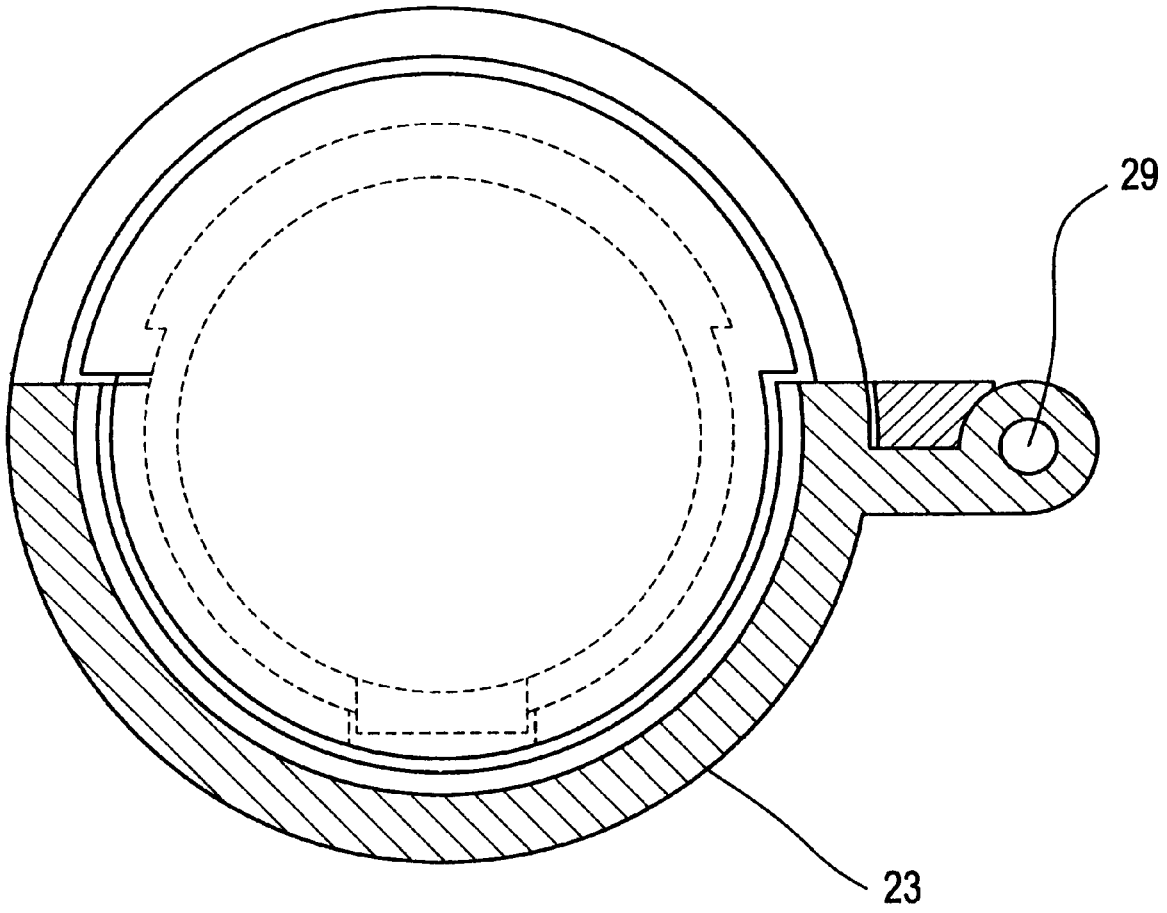
FIG. 18 represents a top plan view, partially sectional of the set for spraying flask closure in the assembled position.

FIGS. 16 to 18 illustrate the assembled closure set on a flask 30 having a shoulder 31, a neck 32 and a mouth 33. These are represented with the sole objective of illustrating the invention. This flask is provided with a usual spraying valve system (aerosol type) having an activation button 37, in which can be found the aperture 38 meant for product exit. This aperture is covered by the lid of the closure set when it is in its closed position. The valve system comprises also a catching tube 39, which crosses a cylindrical or lightly conical portion 35, and an assembling ring 34 that can be found over the mouth 33 of the flask 30.

When the lid is its opened position, the aperture 38 becomes free to spray the flask contents. To change to the closed position, the lid 9 is rotated. The pivoting axis is the pin 39 housed in the described system, which is illustrated in the figures referring to the collar 18 and the lid 9. The lid should be rotated until the edges 10*a* and 10*b* strike against the step formed by the relief in part 23, of the upper peripheral rim of the collar 18.

As to exemplify the invention set, the pieces are made of polypropylene. The collar and the lid receive a metallic coating in silver color.

Although the invention has been described in its preferable configuration, it is evident that the above described. elements can be substituted by others of equivalent function, with no changes in the inventive scope according to the enclosed claims.

What is claimed is:

1. A closure set for enclosing a spraying valve of a spraying flask which has a flask axis, said set comprising a shoulder (1), a collar (18) and a lid (9);

said shoulder being adapted to rest directly against an upper portion of a flask and being linked to said collar; said lid being hinged on said collar and being adapted to cover a spraying aperture of said spraying valve while at a closed position and to allow operation of said spraying valve while at an open position, said lid having a rotation movement through a limited arc between said closed and open positions;

said shoulder having a body (3) for receiving a neck (4) of a spraying flask, and a mouth (5) to which said collar is fitted, said lid being hinged on said collar so that rotation movement of said lid is about an axis parallel to said flask axis, said lid including a top (13) and a wall (10), said wall of said lid covering said spraying aperture of said spraying valve when said lid is at said closed position, said top entirely overlying said spraying valve to prevent valve operation when said lid is at said closed position, said lid being hingedly connected to said collar.

2. A closure set according to claim 1, wherein the collar has an upper surface and a vertical post, said vertical post extending a substantial distance above said upper surface, said lid being hingedly connected to said vertical post.

3. A closure set according to claim 1, wherein said collar has a cylindrical lower portion;

said lid having a semicylindrical wall and a circular top;

said cylindrical lower portion and said semicylindrical wall having substantially a same diameter.

4. A closure set according to claim 1, wherein said collar has an upper surface, said lid having a lower surface which faces and is aligned with said upper surface of the collar when the lid is in its closed position.

5. A closure set according to claim 1, wherein the collar includes a vertical post to which said lid is hingedly connected, said collar having an abutment which determines the closed position of the lid, said lid having a lower portion which engages said abutment when the lid is in its closed position.

6. A closure set for enclosing a spraying valve of a spraying flask which has a central longitudinal axis, said set comprising a shoulder (1), a collar (18) and a lid (9);

said shoulder being adapted to rest directly against an upper portion of a flask and being linked to said collar;

said lid being hinged on said collar and being rotatable about an axis parallel to said flask axis;

said lid being adapted to cover a spraying aperture of said spraying valve while at a closed position and to allow operation of said spraying valve while at an open position, said lid having a rotation movement through a limited arc between said closed and open positions;

said collar having a wall with an upper surface;

said lid having a wall for obstructing spray from a spraying aperture of a spraying valve of a spraying flask of a closure set to which said flask closure is attached, said wall of said lid having a horizontal cross section which corresponds in shape to only a portion of said upper surface of said collar, said wall of said lid being vertically aligned with said upper surface of said collar when said lid is in its closed position;

said lid including a top for obstructing manual access, from above, to a spraying valve of a spraying flask to which the closure set is attached.

7. In combination, a spraying flask, a spraying valve, and a closure set for selectively preventing operation of said spraying valve;

said spraying flask having a central longitudinal axis;

said spraying valve having a spraying aperture and an upper surface which is manually depressible to actuate said spraying valve;

said closure set including a shoulder (1), a collar (18) and a lid (9);

said shoulder being mounted on an upper portion of said flask and being linked to said collar;

said collar being mounted on an upper portion of said shoulder;

said lid including a wall and being hingedly connected to said collar for swinging movement between a closed position and an open position, said swinging movement being about an axis which is parallel to said central longitudinal axis;

said lid when in its closed position preventing manual operation of said valve by obstructing manual access to said upper surface of said spraying valve, said lid when in its closed position obstructing said spraying aperture;

said lid when in its open position enabling valve operation by permitting unobstructed manual access to said upper surface of said spraying valve, said spraying aperture being unobstructed by said lid when said lid is in its open position.

8. The combination according to claim 7, wherein said collar has an upper surface, said lid having a lower surface which faces and is aligned with said upper surface of the collar when the lid is in its closed position.

9. A closure set for enclosing a spraying valve of a spraying flask which has a flask axis, said set comprising a shoulder (1), a collar (18) and a lid (9);

said shoulder being adapted to rest directly against an upper portion of a flask and being linked to said collar; said lid being hinged on said collar and being adapted to cover a spraying aperture of said spraying valve while at a closed position and to allow operation of said spraying valve while at an open position, said lid having a rotation movement through a limited arc between said closed and open positions;

said collar having a wall with an upper surface and a vertical post;

said vertical post extending a substantial distance above said upper surface;

said lid being hingedly connected to said vertical post and having a wall for obstructing spray from a spraying aperture of a spraying valve of a spraying flask of a closure set to which said flask closure is attached, said wall of said lid having a horizontal cross section which corresponds in shape to only a portion of said upper surface of said collar, said wall of said lid being vertically aligned with said upper surface of said collar when said lid is in its closed position;

said lid including a top for obstructing manual access, from above, to a spraying valve of a spraying flask to which the closure set is attached.

10. A closure set for enclosing a spraying valve of a spraying flask which has a flask axis, said set comprising a shoulder (1), a collar (18) and a lid (9);

said shoulder being adapted to rest directly against an upper portion of a flask and being linked to said collar; said lid being hinged on said collar and being adapted to cover a spraying aperture of said spraying valve while at a closed position and to allow operation of said spraying valve while at an open position, said lid having a rotation movement through a limited arc between said closed and open positions;

said collar has a cylindrical lower portion and having a wall with an upper surface;

said lid having a circular top and a semicylindrical wall for obstructing spray from a spraying aperture of a spraying valve of a spraying flask of a closure set to which said flask closure is attached, said wall of said lid having a horizontal cross section which corresponds in shape to only a portion of said upper surface of said collar, said wall of said lid being vertically aligned with said upper surface of said collar when said lid is in its closed position;

said cylindrical lower portion of said collar and said semicylindrical wall Of said lid having substantially the same diameter;

said lid including a top for obstructing manual access, from above, to a spraying valve of a spraying flask to which the closure set is attached.

11. A closure set for enclosing a spraying valve of a spraying flask which has a flask axis, said set comprising a shoulder (1), a collar (18) and a lid (9);

said shoulder being adapted to rest directly against an upper portion of a flask and being linked to said collar; said lid being hinged on said collar and being adapted to cover a spraying aperture of said spraying valve while at a closed position and to allow operation of said spraying valve while at an open position, said lid having a rotation movement through a limited arc between said closed and open positions;

said collar having a wall with an upper surface and having a vertical post to which said lid is hingedly connected, said collar having an abutment which determines the closed position of said lid, said lid having a lower portion which engages said abutment when said lid is in its closed position;

said lid having a wall for obstructing spray from a spraying aperture of a spraying valve of a spraying flask of a closure set to which said flask closure is attached, said wall of said lid having a horizontal cross section which corresponds in shape to only a portion of said upper surface of said collar, said wall of said lid being vertically aligned with said upper surface of said collar when said lid is in its closed position;

said lid including a top for obstructing manual access, from above, to a spraying valve of a spraying flask to which the closure set is attached.

12. In combination, a spraying flask, a spraying valve, and a closure set for selectively preventing operation of said spraying valve;

said spraying flask having a flask axis;

said spraying valve having a spraying aperture and an upper surface which is manually depressible to actuate said spraying valve;

said closure set including a shoulder (1), a collar (18) and a lid (9);

said shoulder being mounted on an upper portion of said flask;

said collar being mounted on an upper portion of said shoulder and having an upper surface and a vertical post, said vertical post extending a substantial distance above said upper surface;

said lid having a wall and being hingedly connected to said vertical post of said collar for swinging movement between a closed position and an open position, said swinging movement being about an axis which is parallel to said flask axis;

said lid when in its closed position preventing manual operation of said valve by obstructing manual access to said upper surface of said spraying valve, said lid when in its closed position obstructing said spraying aperture;

said lid when in its open position enabling valve operation by permitting unobstructed manual access to said upper surface of said spraying valve, said spraying aperture being unobstructed by said lid when said lid is in its open position.

13. In combination, a spraying flask, a spraying valve, and a closure set for selectively preventing operation of said spraying valve;

said spraying flask having a flask axis;

said spraying valve having a spraying aperture and an upper surface which is manually depressible to actuate said spraying valve;

said closure set including a shoulder (1), a collar (18) and a lid (9);

said shoulder being mounted on an upper portion of said flask;

said collar being mounted on an upper portion of said shoulder and having a cylindrical lower portion;

said lid including a semicylindrical wall and a circular top and being hingedly connected to said collar for swinging movement between a closed position and an open position, said swinging movement being about an axis which is parallel to said flask axis;

said cylindrical lower portion and said semicylindrical wall having substantially a same diameter;

said lid when in its closed position preventing manual operation of said valve by obstructing manual access to said upper surface of said spraying valve, said lid when in its closed position obstructing said spraying aperture;

said lid when in its open position enabling valve operation by permitting unobstructed manual access to said upper surface of said spraying valve, said spraying aperture being unobstructed by said lid when said lid is in its open position.

14. In combination, a spraying flask, a spraying valve, and a closure set for selectively preventing operation of said spraying valve;

said spraying flask having a flask axis;

said spraying valve having a spraying aperture and an upper surface which is manually depressible to actuate said spraying valve;

said closure set including a shoulder (1), a collar (18) and a lid (9);

said shoulder being mounted on an upper portion of said flask;

said collar being mounted on an upper portion of said shoulder and having a vertical post to which said lid is hingedly connected, said collar having an abutment which determines the closed position of said lid;

said lid having a lower portion which engages said abutment when said lid is in its closed position;

said lid including a wall and being hingedly connected to said collar for swinging movement between a closed position and an open position, said swinging movement being about an axis which is parallel to said flask axis;

said lid when in its closed position preventing manual operation of said valve by obstructing manual access to said upper surface of said spraying valve, said lid when in its closed position obstructing said spraying aperture;

said lid when in its open position enabling valve operation by permitting unobstructed manual access to said upper surface of said spraying valve, said spraying aperture being unobstructed by said lid when said lid is in its open position.

* * * * *